US008656647B2

(12) United States Patent
Bath et al.

(10) Patent No.: US 8,656,647 B2
(45) Date of Patent: Feb. 25, 2014

(54) GUTTER PROTECTOR

(75) Inventors: David J. Bath, Haslett, MI (US); Donald Maynard, East Lansing, MI (US)

(73) Assignee: GutterFlow LLC, East Lansing, MI (US)

( * ) Notice: Subject to any disclaimer, the term of this patent is extended or adjusted under 35 U.S.C. 154(b) by 0 days.

(21) Appl. No.: 13/113,608

(22) Filed: May 23, 2011

(65) Prior Publication Data

US 2011/0283631 A1 Nov. 24, 2011

Related U.S. Application Data

(60) Provisional application No. 61/347,190, filed on May 21, 2010.

(51) Int. Cl.
*E04D 13/064* (2006.01)

(52) U.S. Cl.
USPC ..... 52/12; 52/11; 52/848

(58) Field of Classification Search
USPC ..... 52/11, 12, 848; 210/164, 163, 473, 474
See application file for complete search history.

(56) References Cited

U.S. PATENT DOCUMENTS

| | | | | |
|---|---|---|---|---|
| 474,442 | A | 5/1892 | Byers et al. | |
| 669,495 | A * | 3/1901 | Babcock, F. | 210/474 |
| 1,597,503 | A * | 8/1926 | Andrews | 52/12 |
| 2,305,955 | A * | 12/1942 | Dudley | 210/164 |
| 3,855,132 | A | 12/1974 | Dugan | |
| 4,032,456 | A | 6/1977 | Berce | |
| 4,905,427 | A * | 3/1990 | McPhalen | 52/12 |
| 4,949,514 | A | 8/1990 | Weller | |
| 4,964,247 | A | 10/1990 | Spica | |
| 5,103,601 | A * | 4/1992 | Hunt | 52/12 |
| 5,107,635 | A | 4/1992 | Carpenter | |
| 5,409,602 | A * | 4/1995 | Sorenson | 210/162 |
| 5,536,406 | A * | 7/1996 | Silva | 210/460 |
| 5,623,787 | A | 4/1997 | Ali | |
| RE36,343 | E * | 10/1999 | Silva | 210/460 |
| 6,223,474 | B1 * | 5/2001 | Kafton | 52/12 |
| 6,282,845 | B1 * | 9/2001 | Hines | 52/12 |
| 6,293,054 | B1 * | 9/2001 | Cangialosi | 52/12 |
| D613,380 | S | 4/2010 | Contreras | |
| 2010/0207961 | A1 | 8/2010 | Zomet | |

FOREIGN PATENT DOCUMENTS

JP 05209450 A * 8/1993

* cited by examiner

*Primary Examiner* — Robert Canfield
*Assistant Examiner* — Jessie Fonseca
(74) *Attorney, Agent, or Firm* — Blue Filament Law PLLC; Avery N. Goldstein; Marc S. Balban

(57) ABSTRACT

A gutter protector is provided that has a top surface defining a front edge and a back edge. The protector also has a first side extending from the front edge to the back edge and extending at an angle α from the top surface and having a gutter contacting first edge, a second side extending from the front edge to the back edge and extending at an angle β from the top surface and having a gutter contacting second edge. A notch is provided in the front edge adapted to engage a complementary notch in an article to couple the gutter protector to the article, thereby allowing protectors to be engaged and pushed collectively down a gutter course to facilitate installation.

12 Claims, 2 Drawing Sheets

GUTTER PROTECTOR

RELATED APPLICATIONS

This application claims priority benefit to U.S. Provisional Application 61/347,190 filed 21 May. 2010; the contents of which are hereby incorporated by reference.

FIELD OF THE INVENTION

The present invention in general relates to a gutter protector insert for a rain gutter and in particular, to a gutter protector configured to facilitate push installation along a gutter course.

BACKGROUND OF THE INVENTION

The inclusion of some manner of screen within a gutter to allow water transport while precluding the accumulation of debris within the gutter represents a well-established goal to limit seasonal cleanings. In deciduous forest climates, gutters are routinely clogged throughout the growing season by fallen blossoms, seed pods, and leaves. Failure to timely clear obstructions from gutters results in water damage.

Numerous attempts are found in the prior art to eliminate or at least reduce the frequency of this dangerous and time-consuming activity. Representative of these efforts are U.S. Pat. Nos. 4,964,247; 4,949,514; 5,103,601; 6,223,474; and 6,293,054. Common problems associated with prior art devices have included complex fixturing that makes eventual cleaning of the gutter difficult. Additionally, complex fixturing associated with such devices further adds to the cost and danger of a retrofit installation.

Thus, there exists a need for a gutter protector that is easy to install and does not impede gutter cleaning when needed.

SUMMARY OF THE INVENTION

A gutter protector is provided that has a top surface defining a front edge and a back edge. The protector also has a first side extending from the front edge to the back edge and extending at an angle $\alpha$ from the top surface and having a gutter contacting first edge, a second side extending from the front edge to the back edge and extending at an angle $\beta$ from the top surface and having a gutter contacting second edge. A notch is provided in the front edge adapted to engage a complementary notch in an article to couple the gutter protector to the article, thereby allowing protectors to be engaged and pushed collectively down a gutter course to facilitate installation. A gutter protector is also provided in which the top surface and the first side and the second edge terminating in a first end and a second end. The protector is well-suited for overlying a downspout of a gutter.

A process of protecting a gutter from debris is provided that includes the insertion of a protector into the gutter and then interlocking the protector with a second of the protectors to form a joined protector unit. The joined protector unit is amenable to be pushed along the gutter.

DETAILED DESCRIPTION OF THE PREFERRED EMBODIMENTS

The present invention has utility as a gutter protector that inhibits gutter fouling leading to water pooling by limiting the ability of debris to form a dam within a rain gutter. An inventive gutter protector has the attributes of being easily assembled by interlocking engagement of gutter protector segments that are retained within a gutter without resort to fasteners so as to promote easy removal and gutter cleaning as required.

Figure 1:
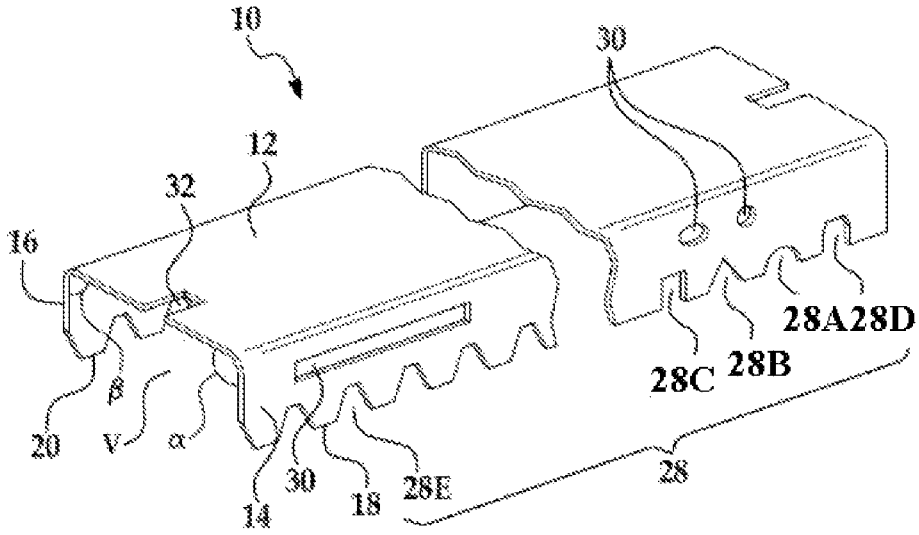
FIG. 1 is a perspective view of an inventive gutter protector.

The present invention is further detailed with respect to the following figures where like numerals used between figures have like meaning. An inventive gutter protector is shown in FIG. 1 generally at 10. The gutter protector 10 has a top surface 12 that extends lengthwise along the water flow axis of a rain gutter (not shown). The top surface 12 is bounded by sides 14 and 16 with each side 14 and 16 engaging a rain gutter along edges 18 and 20, respectively. The top surface 12 contacts the sides 14 and 16 at angles $\alpha$ and $\beta$, respectively. While the application Figures show side 14, side 16 has a mirror-image like appearance to side 14. Angles $\alpha$ and $\beta$ are each independently between 80 and 150 degrees. Preferably, both $\alpha$ and $\beta$ are between 80 and 100 degrees. It has been found that sides projecting from a top surface at larger angles tend to create a crease in which debris tends to accumulate. At least one of the edges 18 or 20 includes multiple cutouts 28 that extend from the edge toward the top surface 12. Cutout 28 is readily provided in a variety of shapes illustratively including semicircular 28A, triangular 28B, rectilinear 28C, and other polygonal shapes 28D. As depicted in FIG. 1, a variety of such cutouts 28 are provided, including a truncated triangular cutout 28E. As shown, it is appreciated that a cutout can taper in shape inward along a side or flare outward, or have uniform dimensions extending from the edge towards the top surface 12. The cutouts 28, regardless of shape, provide a channel for water within a rain gutter while selectively excluding debris. As excluded debris accumulates in a pocket formed between an interior wall of a rain gutter and the exterior of a side 14 or 16, water ingress through a cutout 28 can become limited and optionally an aperture 30 is included on a side 14. Aeration of interior volume V of an inventive gutter protector 10 also facilitates trapped debris drying and subsequent passive wind removal.

Preferably, the aperture 30 is a slit aperture extending with a long axis of the aperture generally aligned with protector 10. It is appreciated that other shapes and total aperture areas compared to those depicted in the accompanying figures are operative herein.

Figure 2A:
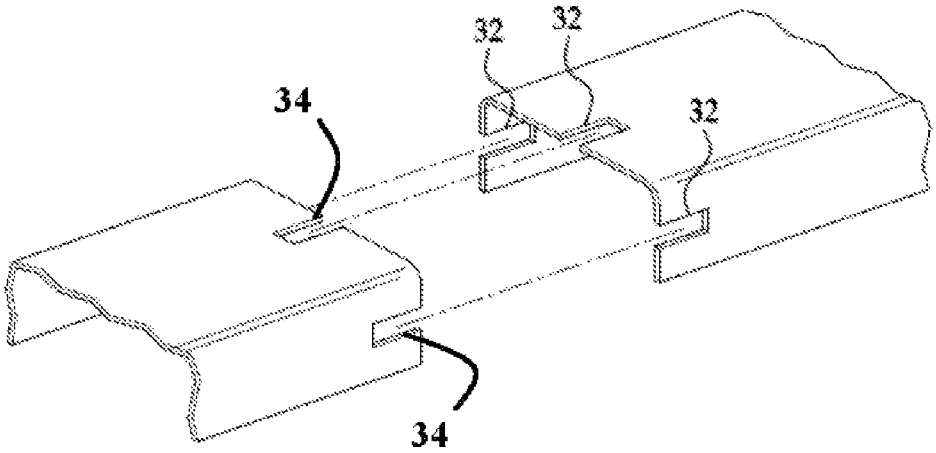
FIGS. 2A and 2B are perspective views showing the engagement of inventive gutter protector terminal joining elements to facilitate assembly of a gutter protector system according to the present invention.
Figure 2B:
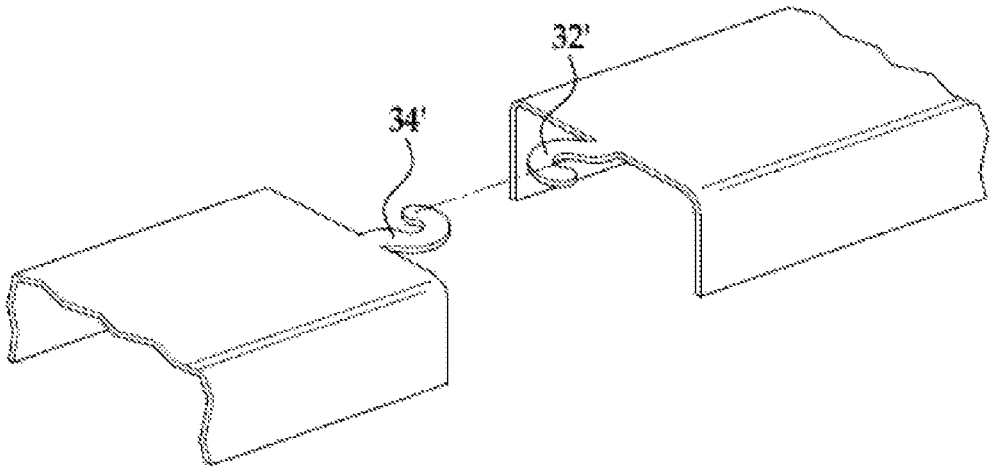

An inventive gutter protector 10 has a terminal joining element 32 adapted to engage a complementary joining element portion 34. As best seen in FIGS. 2A and 2B, the joining element 32 or 32', upon coupling to the complementary joining element portion 34 or 34', interlocks inventive gutter protector 10 with an article, such as another piece of gutter protector 10. Joining elements 32 or 32' are readily placed on top surface 12, one of sides 14 or 16, or a combination thereof. Preferably, the joining element 32 and the complementary joining element portion 34 are both midline notches of like dimensions that engage with a partial rotation and upon being placed in parallel form a joinder sufficient to allow the joined protectors 10 to be pushed collectively within a rain gutter thereby saving the labor of installer movement along a gutter course. Instead, an installer placers a first protector 10 into a gutter, interlocks a second such protector, as shown for example in FIG. 2A or 2B then pushing joined protectors 10 along the length of a gutter with further addition of protectors and sliding to fill a complete course without the installer physically having to move along the length of the course of the gutter.

An inventive gutter protector 10 is preferably formed from a roll of sheet material of a weather resistant thermoplastic material or aluminum. An inventive gutter protector 10 is amenable to prefabrication or alternatively being formed in the field proximal to a gutter with conventional plastic or metal forming equipment such as those systems currently in use to form custom length rain gutters. It is appreciated that an inventive gutter protector 10 is readily painted or colored. A painted or colored gutter protector, especially when painted or colored with a dark color such as black, reduces weathering and also tends to absorb solar radiation thereby speeding ice melt in frozen climates.

Figure 3:
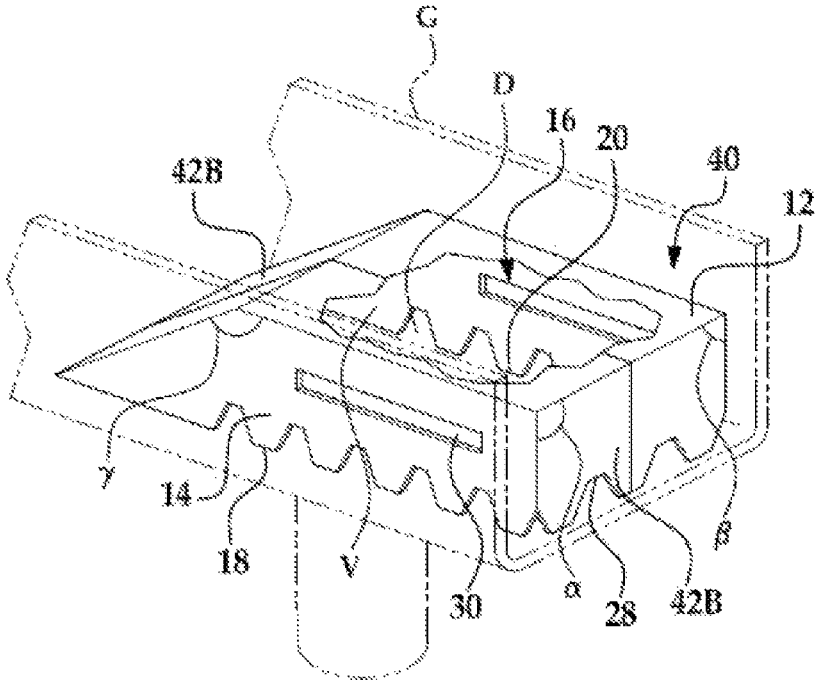
FIG. 3 is a perspective, partial cutaway view of an inventive gutter protector particularly well suited to overlie a gutter downspout.

An inventive gutter protector particularly well-suited for overlying a gutter downspout, as opposed to filling the full course of a gutter is shown is shown in FIG. 3 generally at 40 in the context of a downspout region D of a partial cutaway gutter G shown in ghost. Like numerals or primed numerals have the meaning ascribed to the like numeral with respect to the aforementioned figures. The gutter protector 40 has a top surface 12 bounded by sides 14 and 16 with each side 14 and 16 engaging a rain gutter along edges 18 and 20, respectively. The top surface 12 contacts the sides 14 and 16 at angles $\alpha$ and $\beta$, respectively. At least one of the edges 18 or 20 includes multiple cutouts 28 that extend from the edge toward the top surface 12. Cutout 28 is readily provided in a variety of shapes as detailed above. The protector 40 has closed ends 42A and 42B that preclude debris from entering the interior volume V and an encompassed downspout D of the gutter G. The ends 42A and 42B optionally have cutouts 28 to accommodate direct flow of water along the course of gutter G. The cutouts 28, regardless of shape, provide a channel for water within a rain gutter while selectively excluding debris. As excluded debris accumulates in a pocket formed between an interior wall of a rain gutter and the exterior of a side 14 or 16, water ingress through a cutout 28 can become limited and optionally an aperture 30 is included on a side 14. The ends 42A and 42B are each optionally formed by folding sheet material used to form sides 14 and 16 or alternatively from a separate piece of material. Additionally, the angle of intersection, $\gamma$ between sidewalls 14 and 16 with end 42A, while depicted as being 135 degrees, is readily formed at angles of between 80 and 150 degrees. End 42B is shown with a corresponding angle $\gamma$ of 90 degrees. Ends 42A and 42B are readily formed by folding and joining the sheet material such that the protector 40 is a unitary article.

While the present invention has been illustrated and described as embodied in an exemplary embodiment, e.g. an embodiment having particular utility unplugging drains, it is to be understood that the present invention is not limited to the details shown herein, since it will be understood that various omissions, modifications, substitutions and changes in the forms and details of the disclosed cleaning apparatus and its operation may be made by those skilled in the art without departing in any way from the spirit and scope of the present invention.

Patents and publications mentioned in the specifications are indicative of the levels of those skilled in the art to which the invention pertains. These patents and publications are incorporated herein by reference to the same extent as if each individual application or publication was specifically and individually expressed explicitly in detail herein.

The invention claimed is:

1. A gutter protector system in combination with a gutter comprising:

a gutter having two sides and a gutter base between the two sides to form a U-shaped structure;

a first gutter protector comprising a top surface defining a front edge and a back edge, a first side extending from the front edge to the back edge and extending at an angle a from the top surface and having a gutter contacting first edge adapted to rest on the gutter base of the gutter, a second side extending from the front edge to the back edge and extending at an angle $\beta$ from the top surface and having a gutter contacting second edge adapted to rest on the gutter base of said gutter;

a front edge notch in the front edge and a back edge notch in the back edge, wherein said front edge notch and said back edge notch are both midline notches extending longitudinally substantially parallel to the first side and the second side and are of like dimensions;

a second gutter protector identical to said first gutter protector;

wherein said back edge notch on said first gutter protector is adapted to engage the front edge notch in said second gutter protector to couple said first gutter protector to said second gutter protector; and wherein one of said front edge notch and said back edge notch of said first gutter protector is engaged with one of the second protector front end notch or the second protector back edge notch to form an interlocking joinder with a portion of said first gutter protector overlapping said second gutter protector and a portion of said second gutter protector overlapping said first gutter protector.

2. The gutter protector system of claim 1 wherein the first edge has a plurality of cutouts extending from the first edge toward the top surface.

3. The gutter protector system of claim 2 wherein the plurality of cutouts taper from the first edge.

4. The gutter protector system of claim 1 wherein the first side has an aperture therethrough.

5. The gutter protector system of claim 4 wherein the aperture is rectilinear.

6. The gutter protector system of claim 4 wherein the aperture has a long axis extending along a gutter protector axis between the front edge and the rear edge.

7. The gutter protector system of claim 4 wherein the second side has a second aperture.

8. The gutter protector system of claim 1 wherein the second edge has a second plurality of cutouts extending from the second edge toward the top surface.

9. The gutter protector system of claim 1 wherein the angles $\alpha$ and $\beta$ are both within the range of between 80 and 100 degrees.

10. The gutter protector system of claim 1 wherein the top surface, the first side, and the second side are formed from a unified sheet of material of either plastic or aluminum.

11. The gutter protector system of claim 10 wherein the sheet material is painted or colored.

12. The gutter protector system of claim 1 wherein the front edge notch and the back edge notch are centered on a midline of the top surface.

* * * * *